US007186005B2

(12) United States Patent
Hulse

(10) Patent No.: US 7,186,005 B2
(45) Date of Patent: Mar. 6, 2007

(54) COLOR-CHANGING ILLUMINATION DEVICE

(75) Inventor: George R. Hulse, Niles, IL (US)

(73) Assignee: iLight Technologies, Inc., Chicago, IL (US)

( * ) Notice: Subject to any disclaimer, the term of this patent is extended or adjusted under 35 U.S.C. 154(b) by 118 days.

(21) Appl. No.: 11/122,842

(22) Filed: May 5, 2005

(65) Prior Publication Data

US 2005/0195603 A1 Sep. 8, 2005

Related U.S. Application Data

(63) Continuation-in-part of application No. 11/025,019, filed on Dec. 29, 2004, and a continuation-in-part of application No. 10/455,639, filed on Jun. 5, 2003, now Pat. No. 7,011,421, which is a continuation-in-part of application No. 09/982,705, filed on Oct. 18, 2001, now Pat. No. 6,592,238.

(51) Int. Cl.
*F21V 9/10* (2006.01)
*F21V 14/00* (2006.01)

(52) U.S. Cl. ..... 362/255; 362/84; 362/231; 362/256; 362/293; 362/235; 362/311

(58) Field of Classification Search ..... 362/84, 362/256, 267, 293, 231, 255, 307, 310, 311, 362/800; 313/501–504, 512, 201–204
See application file for complete search history.

(56) References Cited

U.S. PATENT DOCUMENTS 6,319,425 B1 * 11/2001 Tasaki et al. ..... 252/301.36
6,345,903 B1 * 2/2002 Koike et al. ..... 362/249
6,350,041 B1 * 2/2002 Tarsa et al. ..... 362/231
6,361,186 B1 3/2002 Slayden
6,759,803 B2 * 7/2004 Sorg ..... 313/512
6,860,628 B2 * 3/2005 Robertson et al. ..... 362/555

(Continued)

FOREIGN PATENT DOCUMENTS

CA 2 282 819 3/2001

(Continued)

OTHER PUBLICATIONS

European Patent Office, Supplementary European Search Report, Oct. 2, 2006, pp. 1-3, Munich, Germany.

*Primary Examiner*—Sandra O'Shea
*Assistant Examiner*—Jacob Y. Choi
(74) *Attorney, Agent, or Firm*—Stites & Harbison, PLLC; David W. Nagle, Jr.

(57) ABSTRACT

An illumination device for simulating neon or similar lighting is generally comprised of a rod-like member, a housing, a light source, and an intermediate light-transmitting medium extending along and positioned adjacent the light source with a light-receiving surface for receiving light emitted from said light source and a light-emitting surface for emitting light into the rod-like member. This intermediate light-transmitting medium is preferably composed of a matrix of a substantially translucent acrylic, polyurethane, or similar material tinted with a predetermined combination of one or more fluorescent and/or phosphorescent dyes. The intermediate light-transmitting medium is subdivided into independent sections, each of which is provided with differing combinations of fluorescent dye, phosphorescent dye, and/or no dye at all.

24 Claims, 3 Drawing Sheets

U.S. PATENT DOCUMENTS

| | | | | |
|---|---|---|---|---|
| 7,011,421 | B2 * | 3/2006 | Hulse et al. | 362/84 |
| 7,141,442 | B2 * | 11/2006 | Sano | 438/26 |
| 7,157,839 | B2 * | 1/2007 | Ouderkirk et al. | 313/111 |
| 2003/0085642 | A1 * | 5/2003 | Pelka et al. | 313/113 |

FOREIGN PATENT DOCUMENTS

| | | |
|---|---|---|
| WO | 02/065016 | 8/2002 |

* cited by examiner

COLOR-CHANGING ILLUMINATION DEVICE

CROSS-REFERENCE TO RELATED APPLICATIONS

The present application is a continuation-in-part of U.S. patent application Ser. No. 11/025,019 filed Dec. 29, 2004 and is a continuation-in-part of U.S. patent application Ser. No. 10/455,639 filed Jun. 05, 2003 now U.S. Pat. No. 7,011,421, the latter of which is itself a continuation-in-part of U.S. patent application Ser. No. 09/982,705, filed on Oct. 18, 2001, now U.S. Pat. No. 6,592,238, the entire disclosures of which are incorporated herein by reference.

BACKGROUND OF THE INVENTION

The present invention relates to an illumination device for simulating neon or similar lighting, an illumination device that uses one or more fluorescent and/or phosphorescent dyes to provide for emission of light in colors that cannot ordinarily be achieved by the use of LEDs alone, including the ability to control and change the color of the emitted light.

Neon lighting, which is produced by the electrical stimulation of the electrons in the low-pressure neon gas-filled glass tube, has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications, including script writing and designs, because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well-established industry, a competitive lighting device must be lightweight and have superior "handleability" characteristics in order to make inroads into the neon lighting market. Neon lighting is recognized as being fragile in nature. Because of the fragility and heavy weight, primarily due to its supporting infrastructure, neon lighting is expensive to package and ship. Moreover, it is extremely awkward to initially handle, install, and/or replace. Any lighting device that can provide those previously enumerated positive characteristics of neon lighting, while minimizing its size, weight, and handleability shortcomings, will provide for a significant advance in the lighting technology.

The recent introduction of lightweight and breakage resistant point light sources, as exemplified by high-intensity light-emitting diodes (LEDs), have shown great promise to those interested in illumination devices that may simulate neon or similar lighting and have stimulated much effort in that direction. However, the twin attributes of neon lighting, uniformity and brightness, have proven to be difficult obstacles to overcome as such attempts to simulate neon lighting have largely been stymied by the tradeoffs between light distribution to promote the uniformity and brightness.

In an attempt to address some of the shortcomings of neon, commonly assigned U.S. Pat. No. 6,592,238, which is incorporated in its entirety herein by reference, describes an illumination device comprising a profiled rod of material having waveguide properties that preferentially scatters light entering one lateral surface ("light-receiving surface") so that the resulting light intensity pattern emitted by another lateral surface of the rod ("light-emitting surface") is elongated along the length of the rod. A light source extends along and is positioned adjacent the light-receiving surface and spaced from the light-emitting surface a distance sufficient to create an elongated light intensity pattern with a major axis along the length of the rod and a minor axis that has a width that covers substantially the entire circumferential width of the light-emitting surface. In a preferred arrangement, the light source is a string of point light sources spaced a distance apart sufficient to permit the mapping of the light emitted by each point light source into the rod so as to create elongated and overlapping light intensity patterns along the light-emitting surface and circumferentially about the surface so that the collective light intensity pattern is perceived as being uniform over the entire light-emitting surface.

One of the essential features of the illumination device described and claimed in U.S. Pat. No. 6,592,238 is the uniformity and intensity of the light emitted by the illumination device. While it is important that the disadvantages of neon lighting be avoided (for example, weight and fragility), an illumination device would have little commercial or practical value if the proper light uniformity and intensity could not be obtained. This objective is achieved primarily through the use of a "leaky" waveguide rod. A "leaky" waveguide is structural member that functions both as an optical waveguide and light scattering member. As a waveguide, it tends to preferentially direct light entering the waveguide, including the light entering a lateral surface thereof, along the axial direction of the waveguide, while as a light scattering member, it urges the light out of an opposite lateral surface of the waveguide. As a result, what is visually perceived is an elongated light pattern being emitted along the light-emitting lateral surface of the waveguide.

Nevertheless, a problem with illumination devices using leaky waveguides and LEDs, as described and claimed in U.S. Pat. No. 6,592,238, is that the available visible color spectrum is limited by the finite availability of LED colors.

Therefore, in commonly assigned and co-pending U.S. patent application Ser. No. 10/455,639 (U.S. Publication No. 2003/0198049), an application which is also incorporated in its entirety by reference, an illumination device is described that uses fluorescent dyes, thus allowing for emission of light in colors that cannot ordinarily be achieved by use of LEDs alone without significant increase in cost or complexity of the illumination device. Specifically, the illumination device is generally comprised of a rod-like member, a housing, and a light source. In one preferred embodiment, the rod-like member is a waveguide that has an external curved lateral surface serving as a light-emitting surface and an interior lateral surface that serves as a light-receiving surface, such that light entering the waveguide from the light source positioned below the light-receiving surface is scattered within the waveguide so as to exit with diffused distribution out of the curved lateral surface. The housing preferably comprises a pair of side walls that define an open-ended channel that extends substantially the length of the waveguide. The housing generally functions to house the light source and associated electrical accessories, and also preferably serves to collect and reflect light.

Although it is contemplated that various types of light sources could be incorporated into the illumination device described in U.S. patent application Ser. No. 10/455,639, a string or strings of contiguously mounted high-intensity light-emitting diodes (LEDs) is a preferred light source. However, since the available visible color spectrum of an illumination device incorporating LEDs as the light source is limited by the finite availability of LED colors, the illumination device is constructed so as to provide for emission of light with a perceived color that is different than that of the LEDs themselves. Specifically, this is accomplished through the incorporation of a light color conversion system into the illumination device, specifically an intermediate light-transmitting medium extending along and positioned adjacent the light source. This intermediate light-transmitting medium is preferably composed of a substantially translucent polyurethane or similar material tinted with a predetermined combination of one or more fluorescent dyes. Because of the position of the intermediate light-transmitting medium adjacent the light source, light emitted from the light source is directed into the intermediate light-transmitting medium and interacts with the fluorescent dyes contained therein. This light is partially absorbed by each of the fluorescent dyes of the intermediate light-transmitting medium, and a lower-energy light is then emitted from each of the fluorescent dyes and into the light-receiving surface of the waveguide. Thus, through selection of appropriate combinations of dyes and varying the density of the dyes within the intermediate light-transmitting medium, colors across the visible spectrum can be produced, colors that are ultimately observed along the light-emitting surface of the waveguide.

Similarly, in commonly assigned and co-pending U.S. patent application Ser. No. 11/025,019, an application which is also incorporated in its entirety by reference, an illumination device is described that includes an intermediate light-transmitting medium that includes one or more phosphorescent dyes, and thus, also provides a color-changing effect.

It is a paramount object of the present invention to provide an illumination device similar to that described in U.S. patent application Ser. No. 10/455,639 and U.S. patent application Ser. No. 11/025,019, but further allowing for increased ability to control and change the color of the emitted light.

SUMMARY OF THE PRESENT INVENTION

The present invention is an illumination device for simulating neon or similar lighting, an illumination device that uses one or more fluorescent and/or phosphorescent dyes to provide for emission of light in colors that cannot ordinarily be achieved by the use of LEDs alone, including the ability to control and change the color of the emitted light.

An illumination device made in accordance with the present invention is generally comprised of a rod-like member, a housing, and a light source. Light entering the rod-like member from the light source is scattered within the rod-like member so as to exit with diffused distribution. The housing generally functions to house the light source and also preferably serves to collect and reflect light. The best available light source for the purposes of the present invention is a string or strings of contiguously mounted high-intensity light-emitting diodes (LEDs). However, the available visible color spectrum of an illumination device incorporating LEDs as the light source is limited by the finite availability of LED colors. Thus, the illumination device of the present invention is constructed so as to provide for emission of light with a perceived color that is different than that of the LED itself.

Such color changing is accomplished through the incorporation of a light color conversion system into the illumination device, specifically an intermediate light-transmitting medium extending along and positioned adjacent the light source with a light-receiving surface for receiving light emitted from said light source and a light-emitting surface for emitting light into the rod-like member. This intermediate light-transmitting medium is preferably composed of a matrix of a substantially translucent acrylic, polyurethane, or similar material tinted with a predetermined combination of one or more fluorescent and/or phosphorescent dyes.

Furthermore, in accordance with the teachings of the present invention, the intermediate light-transmitting medium is subdivided into independent sections, each of which is generally associated and aligned with one or more individual LEDs. Adjacent sections are then provided with differing combinations of fluorescent dye, phosphorescent dye, and/or no dye at all.

Finally, it is contemplated that the light source may actually be comprised of two independently controlled strings of LEDs, which are also arranged in an alternating pattern. In this manner, the LEDs associated with a first grouping of alternating sections of the intermediate light-transmitting medium can be powered and controlled independently of a second grouping of alternating sections. As a further refinement, a first string of LEDs can emit light of one color, while a second string of LEDs emits light of a different color. Accordingly, one string of LEDs can be turned on, while the second string remains off, or vice versa. Alternatively, the strings of LEDs can be pulsed at different rates or otherwise controlled in differing manners to generate various colors and/or effects.

DETAILED DESCRIPTION OF THE INVENTION

Figure 1:
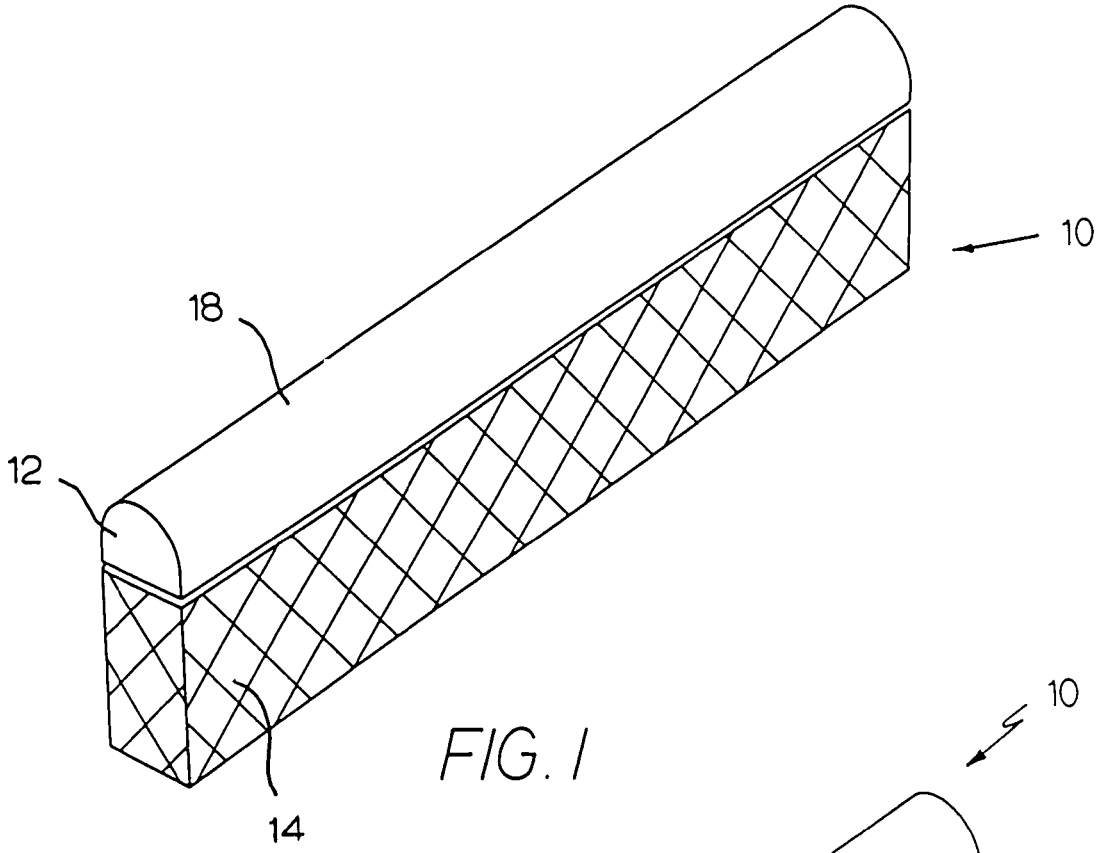
FIG. 1 is a perspective view of an exemplary illumination device made in accordance with the present invention.
Figure 2:
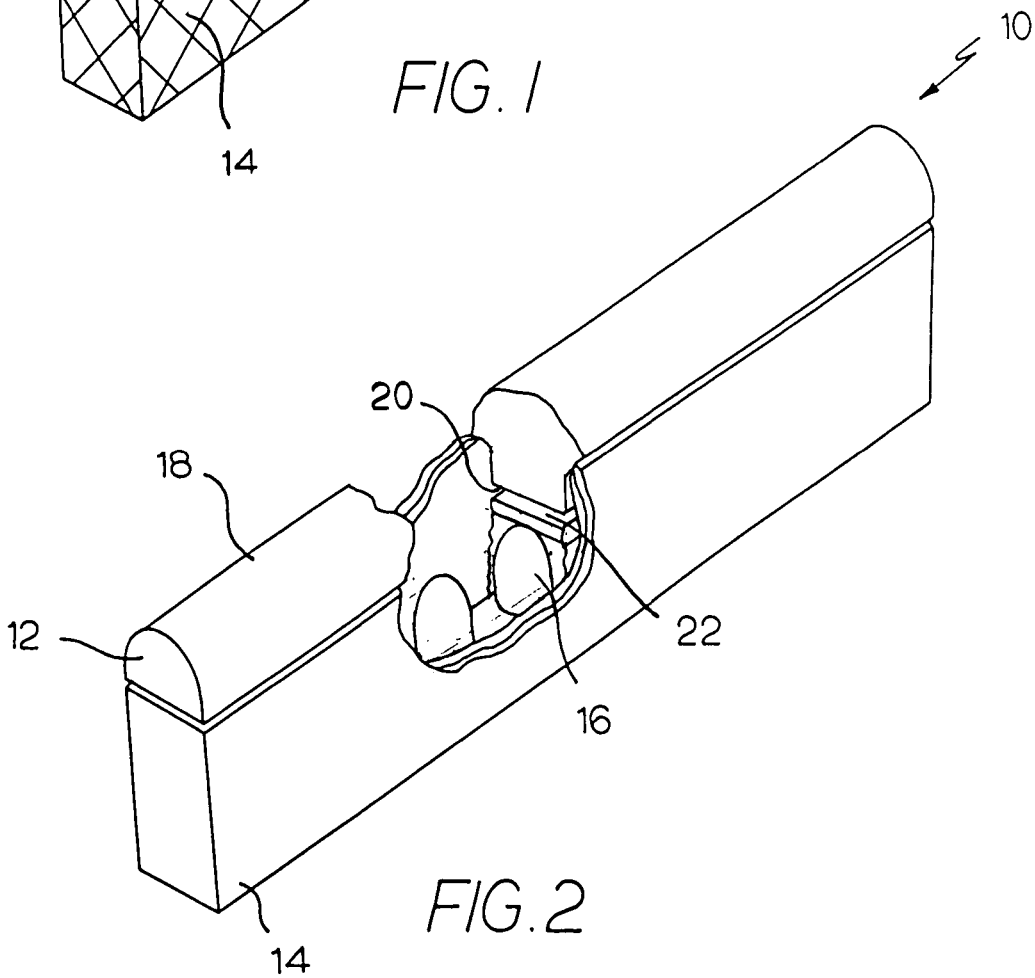
FIG. 2 is a perspective view similar to that of FIG. 1, but with a portion broken away to show the interior of the illumination device.

The present invention is an illumination device for simulating neon or similar lighting, an illumination device that uses one or more fluorescent and/or phosphorescent dyes to provide for emission of light in colors that cannot ordinarily be achieved by the use of LEDs alone, including the ability to control and change the color of the emitted light.

An exemplary illumination device 10 made in accordance with the present invention is illustrated in FIGS. 1–4. The illumination device 10 is generally comprised of a rod-like member 12, a housing 14, and a light source 16. In this exemplary embodiment, the rod-like member is a "leaky"

waveguide 12 that has an external curved lateral surface 18 serving as a light-emitting surface and an interior lateral surface 20 that serves as a light-receiving surface. The characteristics of this waveguide 12 will be further described below, but in general, light entering the waveguide 12 from the light source 16 positioned below the light-receiving surface 20 is scattered within the waveguide 12 so as to exit with diffused distribution out of the curved lateral surface 18.

Figure 3:
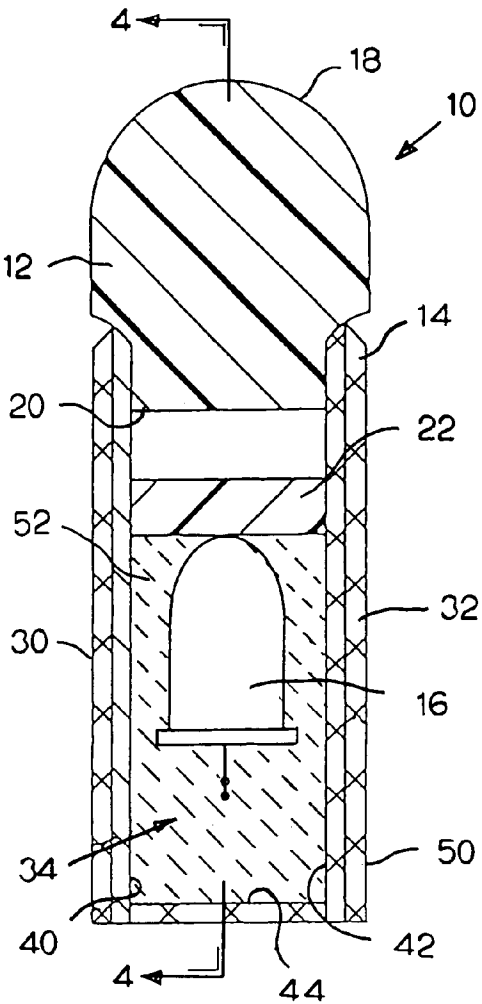
FIG. 3 is a cross-sectional view of the illumination device of FIG. 1.

As best illustrated in FIG. 3, the housing 14 preferably comprises a pair of side walls 30, 32 that define an open-ended channel 34 that extends substantially the length of waveguide 12. The housing 14 generally functions to house the light source 16 and associated electrical accessories (e.g., a circuit board), and also preferably serves to collect and reflect light, as is further described below. Furthermore, while the waveguide 12 and housing 14 may be separately formed and then appropriately joined, they can also be molded or extruded as a unit.

Although it is contemplated that other types of light sources could be incorporated into the illumination device of the present invention, applicant has determined that the best available light source for the purposes of the present invention is a string or strings of contiguously mounted high-intensity light-emitting diodes (LEDs), as illustrated in FIGS. 1–4. However, as mentioned above, the available visible color spectrum of an illumination device 10 incorporating LEDs as the light source 16 is limited by the finite availability of LED colors. Thus, the illumination device 10 of the present invention is constructed so as to provide for emission of light with a perceived color that is different than that of the LED itself.

Similar to the illumination devices described in commonly assigned and co-pending U.S. patent application Ser. No. 10/455,639 and U.S. patent application Ser. No. 11/025,019, such color changing is accomplished through the incorporation of a light color conversion system into the illumination device 10, specifically an intermediate light-transmitting medium 22 extending along and positioned adjacent the light source 16 with a light-receiving surface for receiving light emitted from said light source 16 and a light-emitting surface for emitting light into the waveguide 12. This intermediate light-transmitting medium 22 is preferably composed of a matrix of a substantially translucent acrylic, polyurethane, or similar material tinted with a predetermined combination of one or more fluorescent and/or phosphorescent dyes. Alternatively, the intermediate light-transmitting medium 22 could be a layer of paint or similar coating tinted with the predetermined combination of dyes and applied to the light-receiving surface 20 of the waveguide 12.

With respect to the use of such fluorescent and/or phosphorescent dyes, fluorescence is the emission of certain electromagnetic radiation (i.e., light) from a body that results from the incidence of electromagnetic radiation on that body. In other words, if light energy is directed into a fluorescent body, that body absorbs some of the energy and then emits light of a lesser energy; for example, blue light that is directed onto a fluorescent body may emit a lower-energy green light. In phosphorescence, the body similarly absorbs some of the light energy color or hue, and then emits light of a lesser energy. However, unlike fluorescent bodies, which generally emit the lower energy light in picoseconds, phosphorescent bodies absorb and emit light at a much slower rate.

Returning to the illumination device 10 of the present invention, the intermediate light-transmitting medium 22 differs from those described in commonly assigned and co-pending U.S. patent application Ser. No. 10/455,639 and U.S. patent application Ser. No. 11/025,019 in at least one important way. In accordance with the teachings of the present invention, the intermediate light-transmitting medium 22 is subdivided into independent sections, each of which is generally associated and aligned with one or more individual LEDs. Adjacent sections are then provided with differing combinations of fluorescent dye, phosphorescent dye, and/or no dye at all. For example, in the exemplary embodiment illustrated in FIG. 4, one grouping of alternating sections 22*a* is tinted with a predetermined combination of one or more fluorescent and/or phosphorescent dyes, while a second grouping of alternating sections 22*b* is substantially translucent, including no dyes. Therefore, assuming for sake of example that the light-emitting diodes 16 all emit blue light, blue light passes directly through the second grouping of alternating sections 22*b* (no dye), while light of a different color or hue is emitted from the first grouping of alternating sections (dyed). Therefore, what is perceived on the light-emitting surface 18 of the waveguide 12, is a combination or blend of the blue light from the LEDs that is passing directly through the second grouping of alternating sections 22*b* (no dye) and the light emitted from the fluorescent and/or phosphorescent dyes of the other grouping of alternating sections 22*a*.

Figure 4:
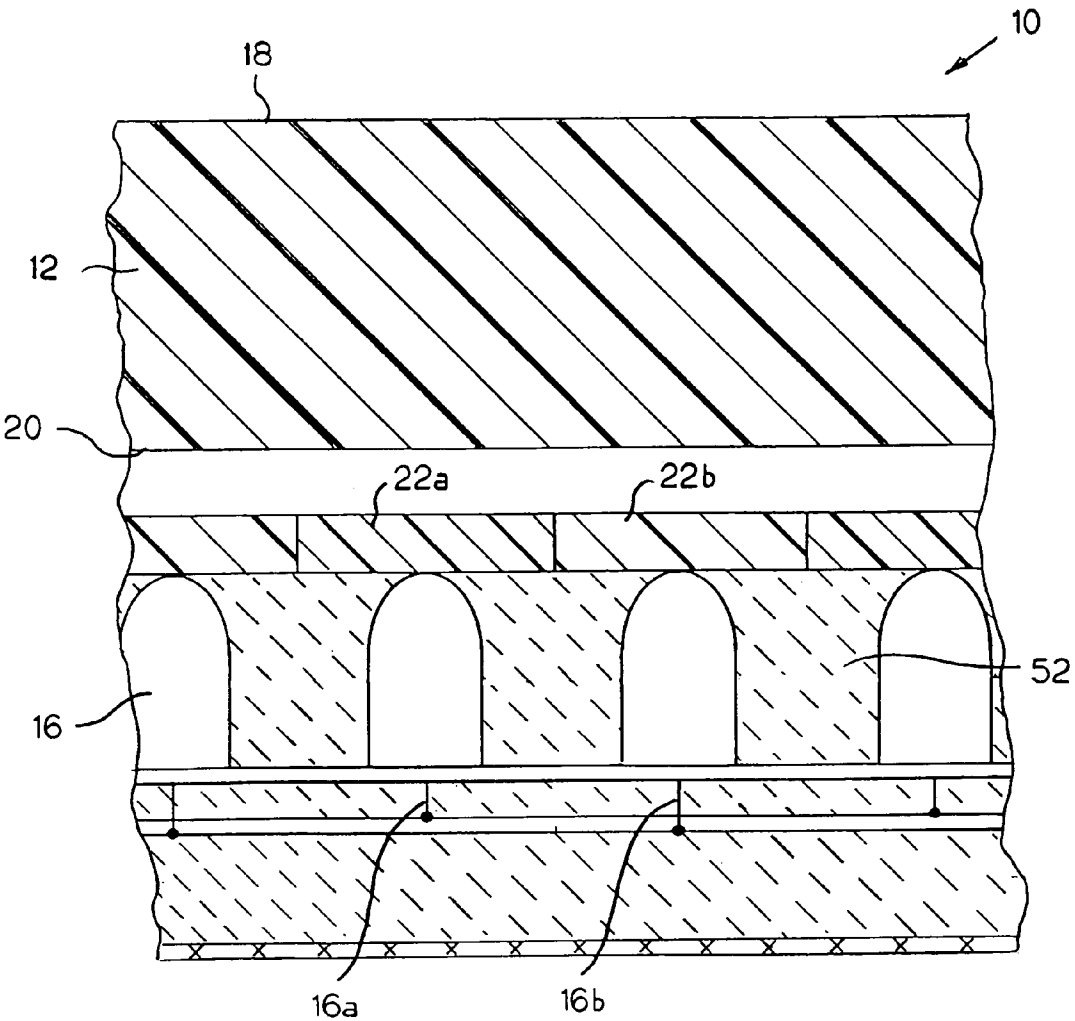
FIG. 4 is a cross-sectional view of the illumination device of FIG. 1, taken along line 4—4 of FIG. 3.

Furthermore, and as best illustrated in FIG. 4, it is contemplated that the light source 16 is actually comprised of two independently controlled strings 16*a*, 16*b* of LEDs, which are also arranged in an alternating pattern. In this manner, the LEDs associated with the first grouping of alternating sections 22*a* of the intermediate light-transmitting medium 22 can be powered and controlled independently of the second grouping of alternating sections 22*b*. As a further refinement, one string 16*a* of LEDs can emit light of one color, while the second string 16*b* of LEDs emits light of a different color. Accordingly, one string 16*a* of LEDs can be turned on, while the second string 16*b* remains off, or vice versa. Alternatively, the strings 16*a*, 16*b* of LEDs can be pulsed at different rates or otherwise controlled in differing manners to generate various colors and/or effects.

For example, perhaps a illumination device made in accordance with the present invention is used to provide ambient, substantially white light. In this regard, it has been demonstrated that individuals sometimes prefer a softer "white" light with a blue tint or hue. Accordingly, a string of white LEDs and a string of blue LEDs can be arranged in an alternating pattern in the illumination device of the present invention. The string of white LEDs can remain illuminated while the string of blue LEDs may be used to selectively add a blue tint or hue to the ambient light.

For another example, in some areas, local ordinances prevent the use of flashing, fading, chasing or other forms of "motion" lighting. However, in some areas, such as Las Vegas or Times Square, such "motion" lighting is preferred as a means to draw attention to a sign. Accordingly, an illumination device made in accordance with the present invention can be used to provide "static" lighting or "motion" lighting depending on where it is placed.

In any event, light passing through and emitted from the dyes contained in the intermediate light-transmitting medium 22 is transmitted through the intermediate light-transmitting medium 22 to the light-receiving surface 20 of the rod-like member 12. As mentioned above, as with the illumination device described in U.S. Pat. No. 6,592,238, the rod-like member 12 in this exemplary embodiment is preferably a "leaky" waveguide 12, i.e., a structural member that functions both as an optical waveguide and light scattering member. As an optical waveguide, it tends to preferentially direct light entering the waveguide 12 along the axial direction of the waveguide, while as a light scattering member, it urges the light out of its light-emitting surface 18. In other words, light enters the light-receiving surface 20 of the waveguide 12 from the adjacent intermediate light-transmitting medium 22 and is directed along at least a portion of the length of the waveguide 12 before being emitted from the light-emitting surface 18 of the waveguide 12. As a result, what is visually perceived is a substantially uniform light pattern being emitted along the light-emitting surface 18 of the waveguide 12, thus making the illumination device 10 an effective simulator of neon lighting.

As described in U.S. Pat. No. 6,592,238, one preferred material for the waveguide 12 is acrylic material appropriately treated to scatter light. Moreover, such acrylic material is easily molded or extruded into rods having the desired shape for a particular illumination application, is extremely light in weight, and withstands rough shipping and handling. While acrylic material having the desired characteristics is commonly available, it can be obtained, for example, from AtoHaas of Philadelphia, Pa. under order number DR66080 with added frosted characteristics. Alternatively, other materials, such as such as bead-blasted acrylic or polycarbonate, or painted acrylic or polycarbonate, may also be used for the waveguide 12 without departing from the spirit and scope of the present invention.

As an alternative, filler may be incorporated into a polyurethane material to give it the desired light scattering properties and allow to serve as an appropriate leaky waveguide 12. Preferably, hollow spheres, called "micro balloons," are used to promote scattering. The micro balloons have approximately the same diameter as a human hair, are void in their interior, and have a shell constructed from glass or other material having an index of refraction similar to that of polyurethane. Because the indices of refraction essentially match, once the micro balloons are placed in the polyurethane, the Fresnel losses at the interfaces are minimal. When light passes through the polyurethane material impregnated with micro balloons, the voids within the respective micro balloons act as a negative focusing lens, deflecting the light. Thus, once impregnated with appropriate micro-balloons, a polyurethane compound will also have the light scattering properties necessary for it to serve as the leaky waveguide 12 for the illumination device 10 of the present invention.

Regardless of the specific material chosen for construction of the waveguide 12, the waveguide 12 preferentially scatters light along its length but ultimately allows light to exit through its light-emitting surface 18 in such a manner that the collective light pattern on the light-emitting surface 18 of the waveguide 12 appears substantially uniform along the length of the waveguide 12.

With respect to the scattering of light so as to cause it to appear uniform along the length of the waveguide 12, it is noteworthy that the fluorescent and/or phosphorescent dyes of the intermediate light-transmitting medium 22 may also cause some scattering of the light emitted from the light source 16. Thus, the incorporation of the intermediate light-transmitting medium 22 not only provides for the desired emission of light of a perceived color different than that of the light source 16, it also causes some scattering of light and thus assists in ensuring that the collective light pattern on the light-emitting surface 18 of the waveguide 12 appears uniform.

As mentioned above, the housing 14 generally functions to house the light source 16 and associated electrical accessories, and also preferably serves to collect light not emitted directly into the light-receiving surface of the intermediate light-transmitting medium 22, re-directing such light it to the intermediate light-transmitting medium 22, as is further described below. Specifically, the housing 14 increases the light collection efficiency by reflecting the light incident upon the internal surfaces of the housing 14 into the intermediate light-transmitting medium 22. In this regard, as best shown in FIG. 3, the illumination device 10 is preferably provided with one or more collection surfaces 40, 42, 44 for collecting and reflecting light not emitted directly into the intermediate light-transmitting medium 22. The collection surfaces 40, 42, 44 could be formed using tape, paint, metal or another light-reflecting material. It is preferred that such light collection surfaces 40, 42, 44 be provided on the internal surfaces of the channel 34, namely, the side walls 30, 32 and portions of the floor of the channel 34. It is additionally preferred that the external surfaces of the side walls 30, 32 be provided with a light-absorbing material 50, for example, tape, paint, or another coating, preferably black or dark in color. Thus, the external surfaces of the housing 14 are visually dark to an observer or otherwise prevent "leakage" of the light emitted from the light source 16.

As a further refinement, and as illustrated in FIG. 3, the volume of the open-ended channel 34 is substantially filled with a translucent potting compound 52 such that the LEDs 16 are at least partially encapsulated in the potting compound 52. In such an embodiment, the light is transmitted through the potting compound 52 before entering the light-receiving surface of the intermediate light-transmitting medium 22. When such a potting compound 52 is incorporated into an illumination device 10 constructed in accordance with the present invention, the potting compound 52 should have an index of refraction essentially matching the index of refraction of the light source 16 to minimize Fresnel losses at the interface.

Furthermore, it is recognized that light from one LED could "leak" into an adjacent dye section, especially if the LEDs 16 are arranged in relatively close proximity to one another. For instance, with reference to FIG. 4, light from an LED of the first string 16*a* could emit some light into the one of the sections of the second grouping 22*b*. To minimize such leakage, various techniques could be employed. For example, although the LEDs 16 illustrated in the Figures are a common type that includes a outer plastic case or lens that houses the actual diode, a surface-mounted light-emitting diode with no such case or lens could be incorporated into the illumination device of the present invention. In this manner, there is less scattering and/or re-direction of the emitted light, and therefore, less likelihood of leakage into adjacent sections of the intermediate light-transmitting medium 22. Furthermore, the illumination device 10 can be constructed with a lower profile, i.e., decreased height. For another example, some form of wall structure could be positioned between adjacent LEDs 16. In this regard, to the extent that each LED 16 is essentially surrounded by a wall structure, and surfaces of the wall structure are provided with a light-reflecting material, such as a mirror, white coating, paint, tape, a collector is formed for directing light upwardly and into the appropriate section of the intermediate light-transmitting medium 22.

Figure 6:
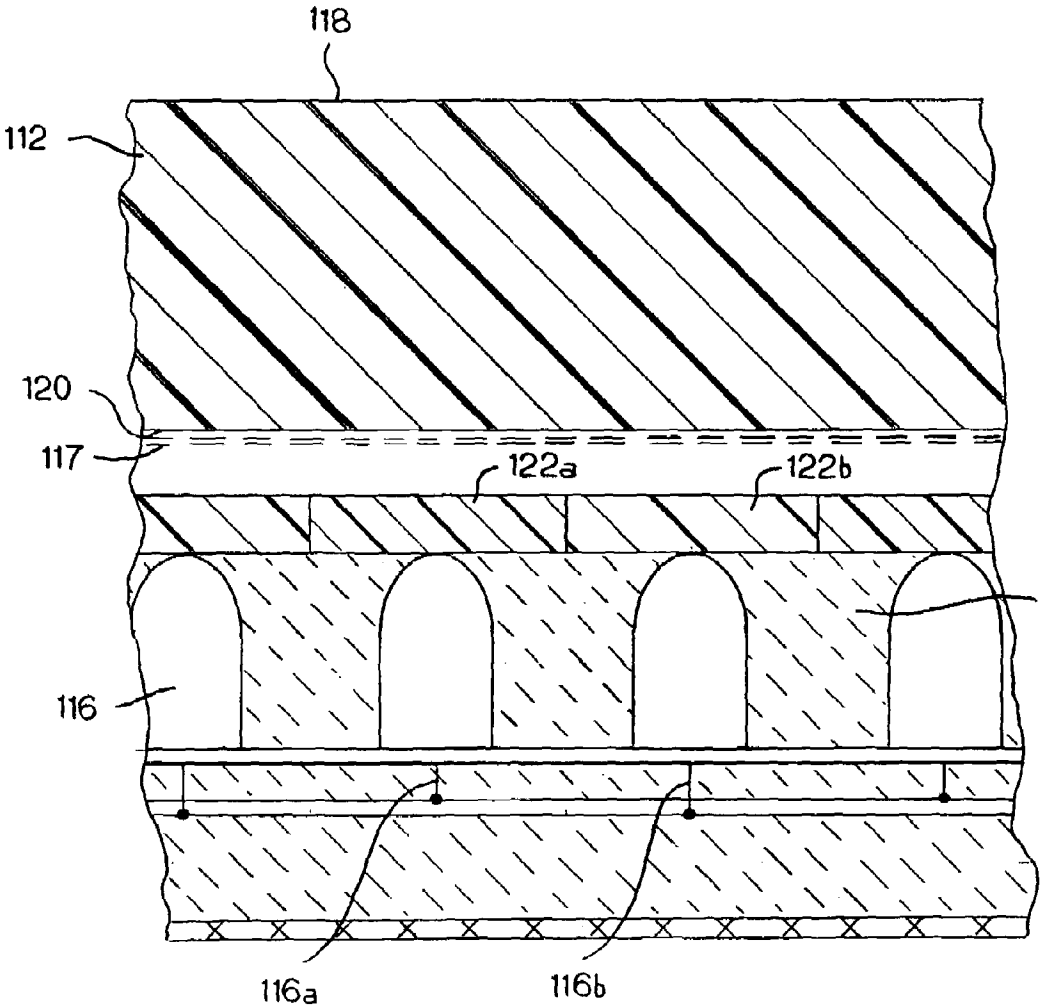
FIG. 6 is a cross-sectional view of the illumination device of FIG. 5, taken along line 6—6 of FIG. 5.
Figure 5:
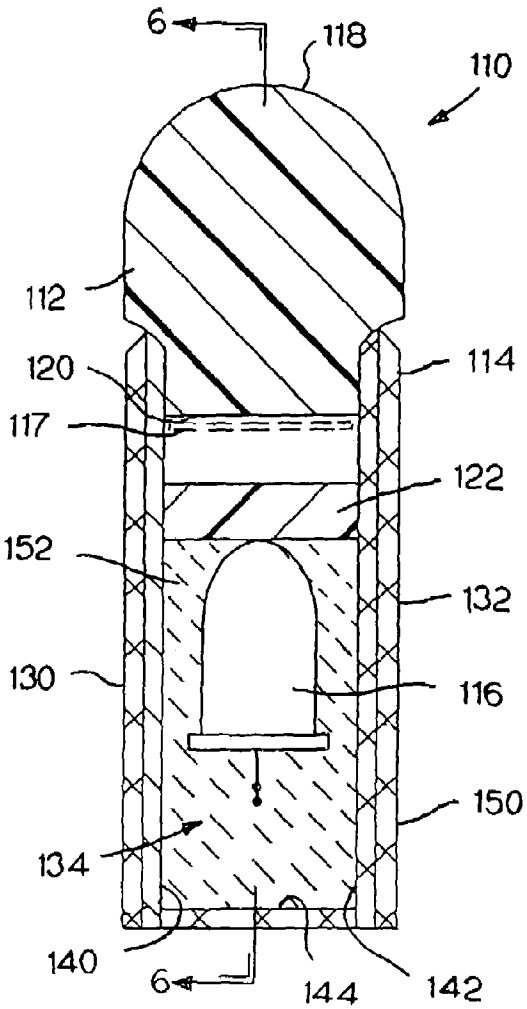
FIG. 5 is a cross-sectional view of an alternate exemplary illumination device made in accordance with the present invention.

FIGS. 5–6 illustrate an alternate exemplary illumination device 110 made in accordance with the present invention. Again, the illumination device 110 is generally comprised of a rod-like member 112, a housing 114, and a plurality of light-emitting diodes 116. The rod-like member is a "leaky" waveguide 112 that has an external curved lateral surface 118 serving as a light-emitting surface and an interior lateral surface 120 that serves as a light-receiving surface. The housing 114 preferably comprises a pair of side walls 130, 132 that define an open-ended channel 134 that extends substantially the length of waveguide 112. The housing 114 generally functions to house the light-emitting diodes 116 and associated electrical accessories (e.g., a circuit board).

Furthermore, similar to the illumination device 10 described above with reference to FIG. 1–4, color changing is accomplished through the incorporation of a light color conversion system, specifically an intermediate light-transmitting medium 122 extending along and positioned adjacent the light-emitting diodes 116 with a light-receiving surface for receiving light emitted from said light-emitting diodes 116 and a light-emitting surface for emitting light into the waveguide 112. This intermediate light-transmitting medium 122 is preferably composed of a matrix of a substantially translucent acrylic, polyurethane, or similar material tinted with a predetermined combination of one or more fluorescent and/or phosphorescent dyes.

Additionally, the alternate exemplary illumination device 110 illustrated in FIGS. 5–6 includes an additional component, a diffracting element 117. This diffracting element 117 is a film or sheet with microscopic grooves that is interposed between the intermediate light-transmitting medium 122 and the waveguide 112. For example, Applicant has determined that one preferred diffracting element 117 for purposes of the present invention is a light shaping diffuser sheet marketed under the trademark LSD® by Physical Optics Corporation of Torrance, Calif., Product No. LSD60x10PC10-2. This diffuser sheet is highly transmissive and is designed to shape the light from a light-emitting diode 16 or other point light source into an oblong pattern (10°×60°). Accordingly, the diffuser sheet essentially homogenizes light from a string of light-emitting diodes to form an elongated, continuous light pattern. In any event, as light passes through the diffracting element 117, it is diffracted and scattered, thus cooperating with the waveguide 112 to cause a substantially uniform light pattern to be emitted and perceived along the light-emitting surface 118 of the waveguide 112.

Finally, although the exemplary embodiments described above include a rod-like member or waveguide 12, 112 to generate a substantially uniform light pattern and to simulate neon, it should be noted that the present invention is not necessarily limited to the use of such a rod-like member or waveguide 12, 112. For example, depending on the relative spacing of the light-emitting diodes, the diffracting sheet 117 described above may be sufficient to diffract and scatter the light emitted from a plurality of light-emitting diodes, resulting in a substantially uniform light pattern along a the visible surface of the diffracting sheet 117. Alternatively, other forms of diffusing elements (e.g., lenses or materials having light-scattering properties), may be used in conjunction with the combination of the light-emitting diodes 16, 116 and the intermediate light-transmitting medium 22, 122 to create an illumination device that provides for emission of light in colors that cannot ordinarily be achieved by use of LEDs, including the ability to control and change the color of the emitted light.

One of ordinary skill in the art will also recognize that additional embodiments are possible without departing from the teachings of the present invention or the scope of the claims which follow. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An illumination device, comprising:

a plurality of point light sources;

a diffusing element having a predetermined length and positioned adjacent said plurality of point light sources; and an intermediate member interposed between said plurality of point light sources and said diffusing element, said intermediate member extending the length of said diffusing element, and said intermediate member being subdivided into independent sections along the length of said diffusing element, a selected number of said independent sections being tinted with a combination of one or more dyes, said intermediate member including a light-receiving surface for receiving light emitted from said a plurality of point light sources and a light-emitting surface for emitting light into said diffusing element, each of said dyes emitting light of at least one predetermined wavelength following absorption of light from said plurality of point light sources, wherein a collective light ultimately emitted along a visible surface of said diffusing element is a combination of the light being passed through or emitted from the independent sections of the intermediate member.

2. The illumination device as recited in claim 1, in which said dyes are fluorescent dyes, phosphorescent dyes, or a combination thereof.

3. The illumination device as recited in claim 1, in which said diffusing element is a substantially rod-like member composed of a material that has both optical waveguide and light scattering properties so as to preferentially scatter light along the length of said rod-like member.

4. The illumination device as recited in claim 3, and further comprising a housing extending substantially the predetermined length of said rod-like member and housing said plurality of point light sources and associated electrical accessories.

5. The illumination device as recited in claim 4, wherein said housing generally comprises a pair of side walls that define an open-ended channel, said plurality of point light sources being received and housed in said open-ended channel.

6. The illumination device as recited in claim 4, and further comprising one or more light collection surfaces provided on internal surfaces of said housing, said light collection surfaces collecting and reflecting light into said intermediate member.

7. The illumination device as recited in claim 5, and further comprising one or more collection surfaces provided on internal surfaces of said side walls, said light collection surfaces collecting and reflecting light into said intermediate member.

8. The illumination device as recited in claim 5, wherein external surfaces of said side walls are provided with a light-absorbing material.

9. The illumination device as recited in claim 1, in which said point light sources are light-emitting diodes.

10. The illumination device as recited in claim 9, in which each independent section of the intermediate member generally is associated with one light-emitting diode.

11. The illumination device as recited in claim 10, in which there is a first grouping of alternating sections of the intermediate member that are tinted with a first combination of one or more dyes.

12. The illumination device as recited in claim 11, in which there is a second grouping of alternating sections of the intermediate member that are substantially translucent.

13. The illumination device as recited in claim 12, in which the plurality of light-emitting diodes are arranged in two separate strings, a first string associated with the first grouping of alternating sections of the intermediate member and a second string associated with the second grouping of alternating sections of the intermediate member.

14. The illumination device as recited in claim 11, in which there is a second grouping of alternating sections of the intermediate member that are tinted with a second combination of one or more dyes.

15. The illumination device as recited in claim 14, in which the plurality of light-emitting diodes are arranged in two separate strings, a first string associated with the first grouping of alternating sections of the intermediate member and a second string associated with the second grouping of alternating sections of the intermediate member.

16. The illumination device as recited in claim 1, and further comprising a diffracting element interposed between the intermediate light-transmitting medium and the diffusing element.

17. The illumination device as recited in claim 1, wherein the intermediate medium is a layer of paint or similar coating applied to a surface of the diffusing member.

18. An illumination device, comprising:

a plurality of point light sources;

a diffracting element having a predetermined length and positioned adjacent said plurality of point light sources; and an intermediate member interposed between said plurality of point light sources and said diffracting element, said intermediate member extending the length of said diffusing element, and said intermediate member being subdivided into independent sections along the length of said diffracting element, a selected number of said independent sections being tinted with a combination of one or more dyes, said intermediate member including a light-receiving surface for receiving light emitted from said a plurality of point light sources and a light-emitting surface for emitting light into said diffracting element, each of said dyes emitting light of at least one predetermined wavelength following absorption of light from said plurality of point light sources, wherein a collective light ultimately emitted along a visible surface of said diffracting element is a combination of the light being passed through or emitted from the independent sections of the intermediate member.

19. The illumination device as recited in claim 18, in which said dyes are fluorescent and/or phosphorescent dyes.

20. The illumination device as recited in claim 18, in which said point light sources are light-emitting diodes.

21. An illumination device, comprising:

a plurality of point light sources;

a diffusing element having a predetermined length and positioned adjacent said plurality of point light sources; and an intermediate member interposed between said plurality of point light sources and said diffusing element, said intermediate member being subdivided into independent sections along the length of said diffusing element, a selected number of said independent sections being tinted with a combination of one or more dyes, said intermediate member including a light-receiving surface for receiving light emitted from said plurality of point light sources and a light-emitting surface for emitting light into said diffusing element, each of said dyes emitting light of a predetermined hue following absorption of light from said plurality of point light sources;

wherein the plurality of point light sources is arranged in at least two separate and independently controlled strings; and wherein a collective light ultimately emitted along a visible surface of said diffusing element has a hue resulting from a combination of light emitted from the first string of point light sources, the second string of point light sources, or both strings, along with light emitted from dyes of said intermediate member.

22. The illumination device as recited in claim 21, in which said dyes are fluorescent and/or phosphorescent dyes.

23. The illumination device as recited in claim 21, in which said point light sources are light-emitting diodes.

24. The illumination device as recited in claim 21, wherein the intermediate medium is a layer of paint or similar coating applied to a surface of the diffusing member.

* * * * *